US009469503B2

(12) United States Patent
Bünter

(10) Patent No.: US 9,469,503 B2
(45) **Date of Patent: *Oct. 18, 2016**

(54) ELEVATOR INSTALLATION MAINTENANCE MONITORING UTILIZING A DOOR ACCELERATION SENSOR

(71) Applicant: Inventio AG, Hergiswil (CH)

(72) Inventor: Adrian Bünter, Giswil (CH)

(73) Assignee: Inventio AG, Hergiswil (CH)

( * ) Notice: Subject to any disclaimer, the term of this patent is extended or adjusted under 35 U.S.C. 154(b) by 310 days.

This patent is subject to a terminal disclaimer.

(21) Appl. No.: 14/202,354

(22) Filed: Mar. 10, 2014

(65) Prior Publication Data

US 2014/0182978 A1 Jul. 3, 2014

Related U.S. Application Data

(63) Continuation of application No. 12/997,718, filed as application No. PCT/EP2009/057380 on Jun. 15, 2009, now Pat. No. 8,678,143.

(51) Int. Cl.

| | |
|---|---|
| ***B66B 1/34*** | (2006.01) |
| ***B66B 3/02*** | (2006.01) |
| ***B66B 5/00*** | (2006.01) |
| ***B66B 13/14*** | (2006.01) |
| *B66B 19/00* | (2006.01) |

(52) U.S. Cl.

CPC ..... *B66B 3/023* (2013.01); *B66B 5/0025* (2013.01); *B66B 13/143* (2013.01); *B66B 19/007* (2013.01)

(58) Field of Classification Search

CPC ... B66B 3/023; B66B 5/0025; B66B 13/143; B66B 19/007

USPC ..... 187/277, 284, 291–293, 301, 303, 316, 187/391–393, 247, 278

See application file for complete search history.

(56) References Cited

U.S. PATENT DOCUMENTS

| | | | | |
|---|---|---|---|---|
| 6,408,986 | B1 | 6/2002 | Ayano et al. | |
| 6,412,604 | B1 | 7/2002 | Schuster | |
| 7,104,363 | B2 | 9/2006 | Mori et al. | |
| 7,484,598 | B2 | 2/2009 | Tyni et al. | |
| 7,533,763 | B2 | 5/2009 | Kattainen et al. | |
| 7,703,579 | B2 | 4/2010 | Tyni et al. | |
| 7,823,706 | B2 | 11/2010 | Tyni et al. | |
| 7,896,137 | B2 | 3/2011 | Ishikawa | |
| 8,678,143 | B2 * | 3/2014 | Bunter | B66B 5/0025 187/247 |
| 9,033,114 | B2 * | 5/2015 | Mizon | B66B 1/00 187/247 |
| 2015/0083528 | A1 * | 3/2015 | Kattainen | B66B 5/0031 187/393 |
| 2015/0284214 | A1 * | 10/2015 | Park | B66B 5/0018 187/393 |

FOREIGN PATENT DOCUMENTS

| | | | |
|---|---|---|---|
| EP | 1415947 | A1 | 5/2004 |
| WO | 2005073119 | A2 | 8/2005 |
| WO | 2007020322 | A1 | 2/2007 |

* cited by examiner

*Primary Examiner* — Anthony Salata

(74) *Attorney, Agent, or Firm* — Fraser Clemens Martin & Miller LLC; William J. Clemens

(57) ABSTRACT

An elevator installation includes at least one car door or floor door and at least one acceleration sensor mounted on the door. The sensor generates measurements that are transmitted wirelessly to a communications module for determining maintenance data.

10 Claims, 3 Drawing Sheets

ELEVATOR INSTALLATION MAINTENANCE MONITORING UTILIZING A DOOR ACCELERATION SENSOR

CROSS-REFERENCE TO RELATED APPLICATIONS

This application is a continuation of the co-pending U.S. patent application Ser. No. 12/997,718 filed Mar. 10, 2011.

FIELD

The disclosure relates to an elevator installation and to a method for maintenance of such an elevator installation.

BACKGROUND

EP 14159337 A1 describes a device and a method for remote maintenance of an elevator installation, which device is installed at the elevator installation and receives first signals from a sensor of the elevator installation, for example from an acceleration sensor. The device converts received first signals into second signals and passes on these second signals for evaluation to a remote maintenance center by way of a telecommunications network.

WO0200702030322A1 describes a further device and a further method for the positioning of an elevator installation, in that a first acceleration sensor is placed on a car and an additional acceleration sensor is placed on a car door, which allows for an independent determination of acceleration of the car and of acceleration of the car door. The positions of the car and the car door are determined through a double integration of the accelerations.

SUMMARY

In some embodiments, the elevator installation comprises at least one door and at least one acceleration sensor; the door is a car door and/or a floor door. The acceleration sensor is mounted on the door and measures acceleration and/or vibration on the door; the acceleration sensor is attached to at least one movable section of the door using at least one attachment substance.

This can have, for example, the advantage that the acceleration sensor can directly detect the opening and/or closing of the door. The acceleration sensor is attached to a movable section of the door, which makes it possible to detect movements, accelerations and vibrations during the opening and closing of the door. The acceleration sensor can be attached to car door as well as a floor door, which makes it possible to monitor both doors.

In some cases, the door is a car door of a car and the acceleration sensor detects accelerations and/or vibrations of the car.

This can be an advantage, since the car door is the location where an acceleration sensor can detect all movements, accelerations and vibrations of the car door and the car. Also, in some embodiments only a single acceleration sensor is needed.

In some cases, the acceleration sensor detects at a floor stop, when the car is stationary, accelerations and/or vibrations of the car door. During travel of the car, when the car door is stationary, the acceleration sensor detects accelerations and/or vibrations of the car.

This can have the particular advantage that the detected movements, accelerations and vibrations can be uniquely associated with either the car door or the car.

The acceleration sensor provides accelerations and/or vibrations of the door or accelerations and/or vibrations of the car through at least one communication path to at least one communications module. The communications module can be placed in a fixed location on the elevator installation or in a mobile location on the car and/or on at least one movable section of the door. This can have the advantage, that the communications module can be placed as desired in the elevator installation.

In some embodiments, at least one energy store is attached to at least one movable door section, which provides electricity to the acceleration sensor and/or the communications module. In some cases, the energy store provides energy-independence for the acceleration sensor and/or the communication module for at least one year.

If the acceleration sensor and/or the communications module are provided with electricity from an energy store, which is independent of the electricity source of the elevator installation and/or the building, the installation of cables can be disposed with. As such, the technology is appropriate for retrofitting, especially with radio signal transmission.

In some cases, the movable door section is a door panel and/or a door strip.

This can be advantageous, as the acceleration sensor can be attached to a planar door panel as well as to an elongated door strip. The installer has great freedom with the installation of the acceleration sensor. On a planar door panel the acceleration sensor can be placed with a flat contact, and on an elongated door strip the acceleration sensor can be placed with a point contact.

In some cases, the acceleration sensor is placed between two door sections in the interior of the door, thus unnoticeable by passengers and protected from theft and vandalism.

In further cases, the acceleration sensor has dimensions of $50\times50\times10$ mm$^3$, preferably $30\times30\times5$ mm$^3$, preferably $20\times20\times2$ mm$^3$. Possibly, the acceleration sensor weighs 10 grams, preferably 5 grams.

In some embodiments, the acceleration sensor is of small and light construction.

Sometimes, the communications path is a signal cable such as a USB cable. The USB cable also realizes, apart from communication of the acceleration signals, an electrical power supply of the acceleration sensor. In further cases, the communication path is a radio connection such as Bluetooth and/or ZigBee and/or WiFi.

Thus, since the communication path can be realized by a standardized and economic USB cable and/or a standardized and economic Bluetooth and/or ZigBee and/or WiFi.

Accordingly, the communications module communicates bidirectionally in at least one network with at least one user module.

This can be of particular advantage, since the communications module communicates with a user module independently of the elevator installation.

In some embodiments, the user module is located in at least one central station and/or with at least one maintenance engineer. In further embodiments, the central station is located remotely from the building of the elevator installation and/or the central station is located in the building of the elevator installation. In additional embodiments, the network is a radio network and/or a fixed network.

This can be similarly of advantage, since the communications module can communicate with a desired user module of a central station and/or a mobile maintenance engineer remote from or near the building.

In some cases, the communications module communicates detected acceleration signals and/or at least one item of maintenance information and/or at least one alarm report to the user module.

The technologies can also relate to a method for maintenance of an elevator installation with at least one door and at least one acceleration sensor, in which accelerations and/or vibrations of the door are detected by the acceleration sensor; accelerations and/or vibrations of the door measured by the acceleration sensor are transmitted as acceleration signals through at least one communications path to a communications module; acceleration signals processed by the communications module are sent by at least one network to a user module.

This can have the advantage that the accelerations and vibrations recorded by the acceleration sensor can be transmitted, through a communications module and independent of the elevator installation, to a user module.

In some embodiments, at least one computer program means is loaded by way of at least one signal line from at least one computer readable data memory into at least one processor of the communications module and/or of the user module. Detected acceleration signals are evaluated by the computer program means.

This can have the particular advantage that acceleration signals detected by the computer program means are logically linked and intelligently evaluated.

In further embodiments, "acceleration of the door" and/or "acceleration of the car" and/or "opening acceleration or closing acceleration of the door" and/or "upward acceleration or downward acceleration of the car" and/or "speed of the door" and/or "speed of the car" and/or "opening speed or closing speed of the door" and/or "upward speed or downward speed of the car" and/or "travel path of the door" and/or "travel path of the car" and/or "opening travel path or closing travel path of the door" and/or "upward travel path or downward travel path of the car" and/or "time instant of the start of acceleration of the door" and/or "time instant of the end of deceleration of the door" and/or "number of door movements" and/or "time duration of the door movement" and/or "time instant of the start of acceleration of the car" and/or "time instant of the end of deceleration of the car" and/or "number of car journeys" and/or "number of floor stops of the car" and/or "time duration of a car journey" and/or "time duration of a floor stop of the car" and/or "horizontal vibrations of the door" and/or "vertical vibrations of the door" and/or "horizontal vibrations of the car" and/or "vertical vibrations of the car" is evaluated from the detected acceleration signals as at least one item of maintenance information.

In additional embodiments, at least one item of maintenance information "number of door movements" and/or "number car journeys" and/or "number of floor stops of the car" and/or "time duration of a car journey" or "time duration of a floor stop of the car" is summated in freely selectable time windows; and that an item of maintenance information "time plot of the door movements" and/or "time plot of the car journeys" and/or "time plot of the floor stops of the car" is provided as the result of the summation.

This can have the advantage that a plurality of maintenance-relevant characteristic values is obtained from detected acceleration signals.

In some cases, the summation of an item of maintenance information is carried out specifically to floor.

This can have the further advantage that maintenance-relevant characteristic values of the elevator installation can be prepared in floor-specific manner.

In additional embodiments, at least one item of maintenance information is compared by the computer program means with at least one reference value. The reference value is loaded by way of the signal line from the computer readable data memory into the processor.

Advantageously In further embodiments, in the case of a negative comparison result at least one alarm report is generated by the computer program means. In the case of a positive comparison result, at least one serviceability report is generated by the computer program means.

This can have the advantage that clear and meaningful reports are generated by the computer program means.

In further cases, an alarm report is generated if an "acceleration of the door" and/or an "acceleration of the car" and/or a "speed of the door" and/or a "speed of the car" and/or a "travel path of the door" and/or a "travel path of the car" and/or a "time duration of the door movement" and/or a "time duration of the car journey" and/or a "time duration of a floor stop of the car" and/or a "number door movements" and/or a "number of car journeys" and/or a "number of floor stops of the car" and/or "horizontal vibrations of the door" and/or "vertical vibrations of the door" and/or "horizontal vibrations of the car" and/or "vertical vibrations of the car" exceeds a reference value.

In additional cases, an alarm report is generated if an "acceleration of the door" and/or an "acceleration of the car" and/or a "speed of the door" and/or a "speed of the car" and/or a "travel path of the door" and/or a "travel path of the car" and/or a "time duration of the door movement" and/or a "time duration of the car journey" and/or a "time duration of a floor stop of the car" and/or a "number door movements" and/or a "number of car journeys" and/or a "number of floor stops of the car" and/or "horizontal vibrations of the door" and/or "vertical vibrations of the door" and/or "horizontal vibrations of the car" and/or "vertical vibrations of the car" and/or a "time plot of the door movements" and/or a "time plot of the car journeys" and/or a "time plot of the floor stops of the car" deviates from a reference value.

In some cases, a serviceability report is generated if an "acceleration of the door" and/or an "acceleration of the car" and/or a "speed of the door" and/or a "speed of the car" and/or a "travel path of the door" and/or a "travel path of the car" and/or a "time duration of the door movement" and/or a "time duration of the car journey" and/or a "time duration of a floor stop of the car" and/or a "number door movements" and/or a "number of car journeys" and/or a "number of floor stops of the car" and/or "horizontal vibrations of the door" and/or "vertical vibrations of the door" and/or "horizontal vibrations of the car" and/or "vertical vibrations of the car" falls below a reference value.

In particular embodiments, acceleration signals detected by the communications module and/or at least one item of maintenance information and/or at least one alarm report is or are communicated in the network to at least one user module of at least one central station and/or of at least one maintenance engineer.

This can be of advantage, since the central station and/or the maintenance engineer can prepare and undertake maintenance actions of the elevator installation with meaningful maintenance data.

In further embodiments, an alarm report is communicated to the central station. Acceleration signals communicated with the alarm report and/or an item of maintenance information communicated with the alarm report is or are investigated by the central station. If at least one disturbance, which is linked with the alarm report, of the elevator installation cannot be eliminated in another mode and manner at least one maintenance engineer who undertakes appropriate maintenance of the elevator installation in the building of the elevator installation is summoned by the central station.

Advantageously In particular embodiments, an item of maintenance information "time plot of the door movement" is investigated by the maintenance engineer in the central station and/or on the way to the elevator installation and the correct opening and/or closing of at least one door is established in floor-specific manner.

In some cases, a favorable point in time, where, in particular, little traffic is to be expected and a possible switching-off of the car of the elevator installation causes little disturbance, for a maintenance visit is derived by the central station and/or by the maintenance engineer from the item of maintenance information "time plot of the car journeys".

This can have the advantage that the maintenance engineer can determine his or her maintenance visit in terms of time so that a temporary non-availability of the elevator installation causes fewest possible disadvantages for the passengers.

In some cases, a computer program product comprises at least one computer program means suitable for realizing the method for maintenance of an elevator installation in that at least one method step is performed when the computer program means is loaded into the processor of a communications module and/or of a user module.

In particular embodiments, the computer readable data memory comprises such a computer program product.

The technologies can also relate to a method for modernization of an existing elevator installation with at least one door and at least one car; at least one acceleration sensor is mounted on the door; at least one communications module is mounted in stationary position at the elevator installation or to be mobile at the car; the acceleration sensor is connected with the communications module by way of at least one communications path.

This can have the advantage that the modernization of an existing elevator installation can be performed simply and quickly. The expert has great freedom not only in the location of mounting of acceleration sensor and/or communications module, but also in the mode and manner of the communications path.

BRIEF DESCRIPTION OF THE DRAWINGS

Exemplifying embodiments of the disclosed technologies are explained in detail by way of the figures, for which purpose.

DETAILED DESCRIPTION

Figure 1:
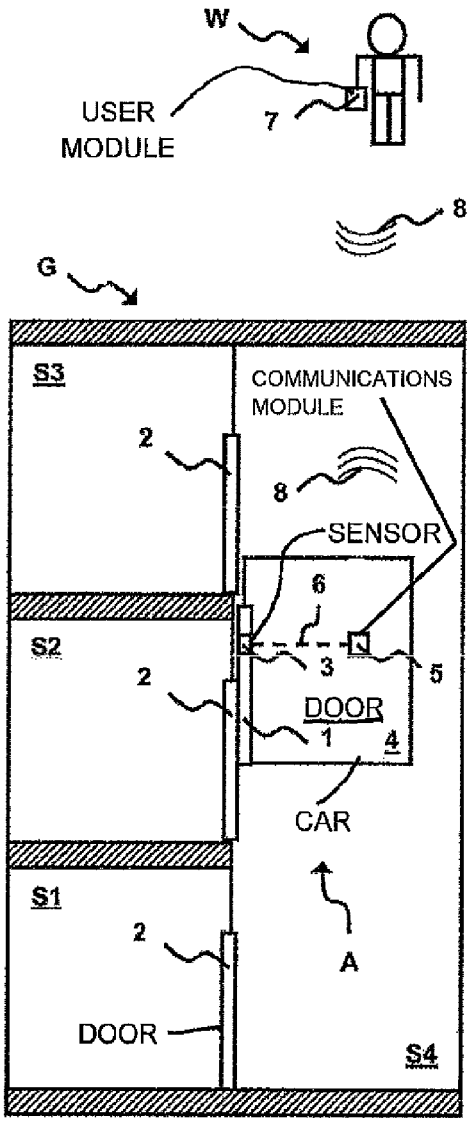
FIG. 1 shows a schematic view of a part of a first exemplifying embodiment of an elevator installation with an acceleration sensor at a car door.
Figure 2:
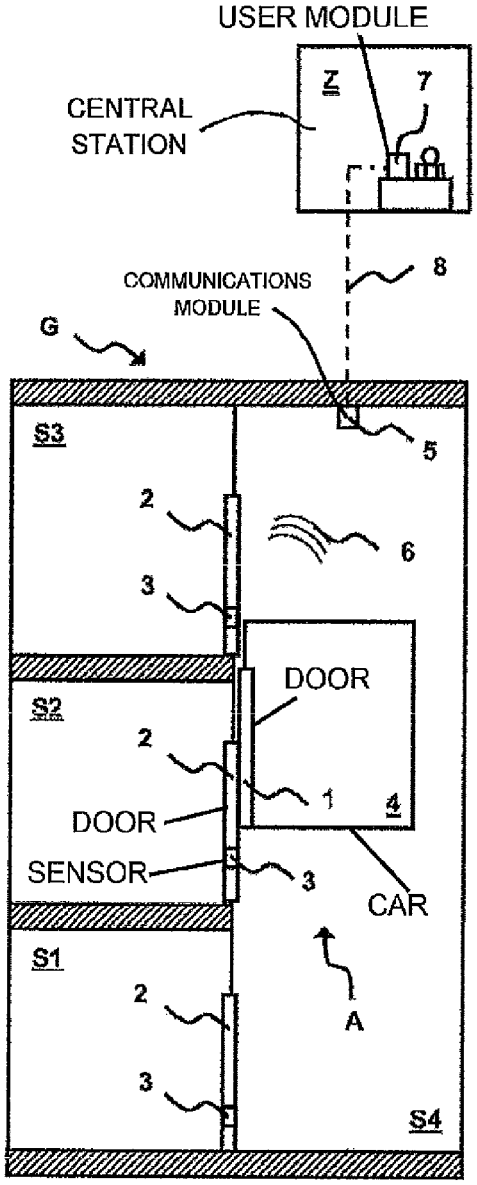
FIG. 2 shows a schematic view of a part of a second exemplifying embodiment of an elevator installation with an acceleration sensor at each floor door.
Figure 3:
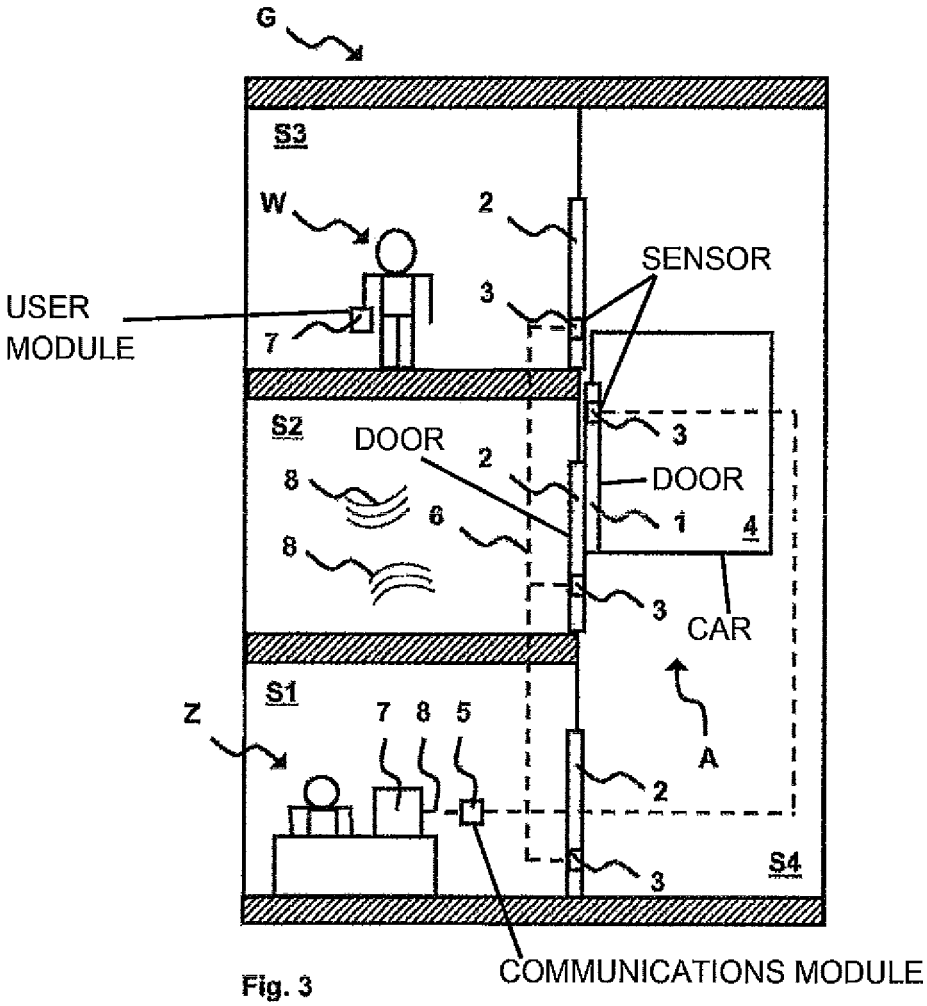
FIG. 3 shows a schematic view of a part of a third exemplifying embodiment of an elevator installation with an acceleration sensor at a car door and an acceleration sensor at each floor door.

FIGS. 1 to 5 show exemplifying embodiments of the disclosed technologies. An elevator installation A is installed in a building (G) with several floors S1-S3. At least one car 4 moves passengers between floors S1-S3 of the building G in upward and downward direction. FIGS. 1 to 3 show three floors S1-S3 and a car 4 in a shaft S4. The car 4 is moved by at least one car drive (not illustrated). With knowledge of the disclosed technologies the expert can, however, also realize an elevator installation with several cars for a building with a greater or lesser number of floors. The passengers can enter and leave the car interior of the car 4 by way of at least one door 1, 2. According to FIGS. 1 and 2 each floor S1-S3 has a floor door 2 and the car 4 has a car door 1. The floor doors 2 and the car door 1 are opened and/or closed by at least one door drive (not illustrated). The disclosed technologies can be realized with couplable doors 1, 2 and/or non-couplable doors 1, 2. For example, at a floor stop when the car 4 stops at a floor S1-S3 a floor door 2 is coupled with the car door 1 and opened and closed together by a door drive. The door drive can be arranged at the car door 1 and/or at the floor door 2. However, it is also possible to not couple the doors 1, 2 with one another, so that each door 1, 2 has an own door drive. With knowledge of the disclosed technologies the expert can obviously also realize an elevator installation A with a car with several car doors, for example with a first car door at a front side of the car and with a second car door at a rear side of the car. Correspondingly, two floor doors are also then provided for each floor so that each of the car doors can be coupled with a floor door at the floor stop.

At least one acceleration sensor 3 is mounted on a door 1, 2 of the elevator installation A. The acceleration sensor 3 is, for example, a micromechanical single or multiple sensor, which is arranged on a substrate. The acceleration sensor 3 is, for example, a Hall sensor or a piezoelectric sensor or a capacitive sensor. The acceleration sensor 3 measures accelerations and/or vibrations in one, two or three axes at, for example, a resolution of 10 mg, preferably 5 mg. Vibrations are measured peak-to-peak. The acceleration sensor 3 measures four, preferably 32, preferably 128, accelerations and/or vibrations per second. The acceleration sensor 3 has at least one output, at which measured accelerations or vibrations can be tapped as acceleration signals. The acceleration sensor 3 has dimensions of $50\times50\times10$ mm$^3$, preferably $30\times30\times5$ mm$^3$, preferably $20\times20\times2$ mm$^3$, and weighs 10 grams, preferably 5 grams. With knowledge of the present technologies the expert can use other measurement principles of acceleration sensors.

The acceleration sensor 3 is mounted on a car door 1 and/or a floor door 2 of the elevator installation A. In the case of couplable doors 1, 2, one acceleration sensor 3 is sufficient in order to detect accelerations and/or vibrations of coupled doors 1, 2. In the case of non-couplable doors 1, 2, one acceleration sensor 3 is necessary per door 1, 2 in order to detect accelerations and/or vibrations of the doors 1, 2. In order to obtain a redundancy in the measuring of the acceleration signals of a door 1, 2, the expert can use more than one acceleration sensor 3 per door 1, 2. According to FIG. 1, one acceleration sensor 3 is mounted on the car door 1 and according to FIG. 2 one acceleration sensor 3 is mounted on each floor door 2. According to FIG. 3 a first acceleration sensor 3 is mounted on the car door 1 and further acceleration sensors 3 are mounted on each floor door 2. In all of the exemplifying embodiments the doors 1, 2 can be coupled and/or non-coupled.

The acceleration sensor 3 is mounted on at least one movable door section 10 of the door 1, 2. The movable door section 10 is a door panel, a door strip, etc. According to FIGS. 4 and 5 the plane of the door movement during opening and/or closing of the door 1, 2 is illustrated by a double arrow. The acceleration sensor 3 is mounted on the door section by a reversible and/or an irreversible fastening means 30. The fastening means 30 is, for example, a force-coupling means such as a magnet and/or a material-coupling means such as an adhesive layer and/or a shape-coupling means such as a rivet. The fastening means 30 is, for example, a force-coupling and shape-coupling means such as a screw. The acceleration sensor 3 is mounted between two door sections 10 in the interior of the door 1, 2 to be imperceptible to a passenger of the elevator installation A.

The acceleration sensor 3 communicates acceleration signals to at least one communications module 5. For that purpose the acceleration sensor 3 is connected by way of at least one communications path 6 with the communications module 5. The communications path 6 can be realized as a signal cable or radio connection. In FIGS. 1 to 5 a radio connection is illustrated by curved multiple lines and a signal cable is illustrated by a dashed line. Known radio connections transmit signals or signal sequences as radio waves. Known signal cables comprise at least one copper wire and/or at least one glass fiber.

Usually, the radio connection 6 between the acceleration sensor 3 and the communications module 5 is established with a sender and a receiver. In that case, the acceleration sensor 3 is at least a sender, and the communications module 5 is at least a receiver. In this way, a unidirectional transmission of information between the acceleration sensor 3 and the communications module 5 is realized. The sender is advantageously a passive sender, similar to an RFID, needing no electric source of its own. Such a sender is, for example, contactlessly provided with inductive energy.

In an alternative embodiment, the communications module 5 is also a sender and the acceleration sensor 3 is also a receiver. Thus a bidirectional transmission of information between the acceleration sensor 3 and the communications module 5 is realized, and the acceleration sensor 3 can be queried through the communications module 5.

Figure 5:
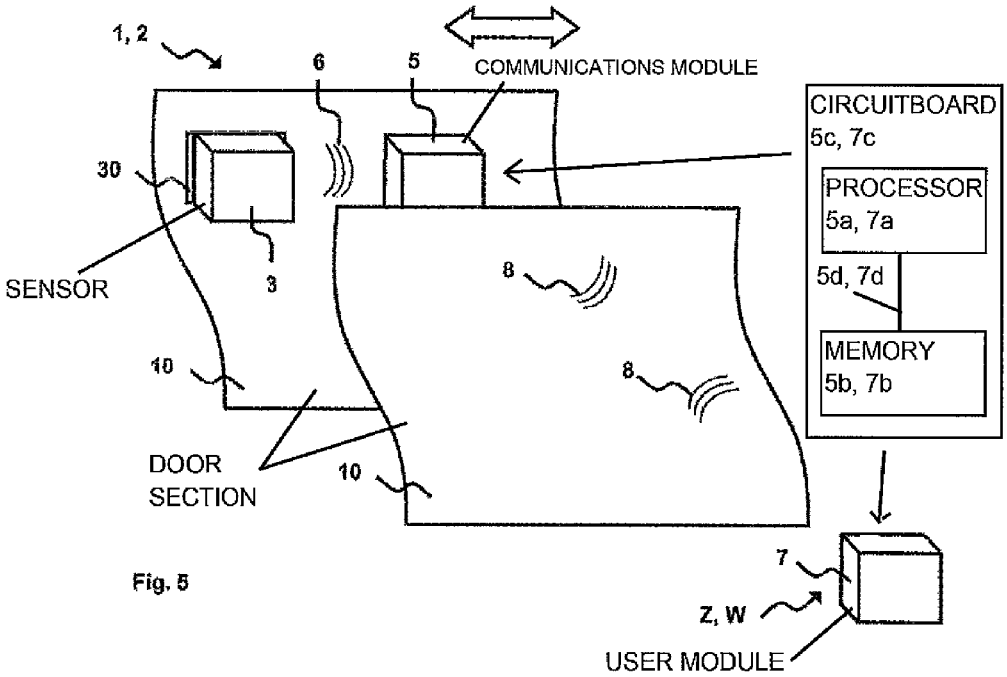
FIG. 5 shows a schematic view of a part of a fifth exemplifying embodiment of an elevator installation with an acceleration sensor at a door.

The communications module 5 therefore has at least one input for reception of communicated acceleration signals. The communications module 5 comprises at least one processor 5*a* and at least one computer readable data memory 5*b*, which are arranged in and/or at the housing of the communications module 5 as shown in FIG. 5. The processor 5*a* and the computer readable data memory 5*b* are arranged on a circuitboard 5*c* and connected together by way of at least one signal line 5*d*. At least one computer program means is loaded from the computer readable data memory 5*b* into the processor 5*a* and executed. The computer program means establishes a communication between the communications module 5 and the acceleration sensor 3 and maintains this communication.

The communications module 5 is mounted in stationary position at the elevator installation A and/or the communications module 5 is mounted at the car 4 or at the movable door section 10 of the door 1, 2 to be mobile. According to FIGS. 2 and 3 the communications module 5 is mounted in stationary position in the shaft S4 (FIG. 2), in the floor S1 and/or the control station Z (FIG. 3). According to FIGS. 1, 4 and 5 the communications module 5 is mounted at the car 4 (FIGS. 1 and 4) and/or at the movable door section 10 of the door 1, 2 (FIG. 5) to be mobile.

When the communications module 5 is positioned on the car 4, the communications module 5 is advantageously near the acceleration sensor 3. Accordingly, the communications module 5 is on the car structure in the area of the movable door leaf on which the acceleration sensor 3 is attached. In this way, short radio transmission distances are achieved.

The communication between the acceleration sensor 3 and the communications module 5 can be unidirectional or bidirectional. In the case of a unidirectional communication the acceleration sensor 3, automatically or in response to an electromagnetic field, communicates acceleration signals and in the case of a bidirectional communication the communications module 5 can additionally communicate, by way of at least one output, interrogations to at least one input of the acceleration sensor 3. When multiple sensors are present, each acceleration sensor 3 is identifiable by a unique address. The communication between the acceleration sensor 3 and the communications module 5 can be carried out in accordance with a known bus protocol such as Universal Serial Bus (USB), Local Operating Network (LON), Modbus, etc.; it can, however, also be carried out according to a known near field communications standard such as Bluetooth (IEEE 802.15.1), ZigBee (IEEE 802.15.4) and WiFi (IEEE 802.11).

Figure 4:
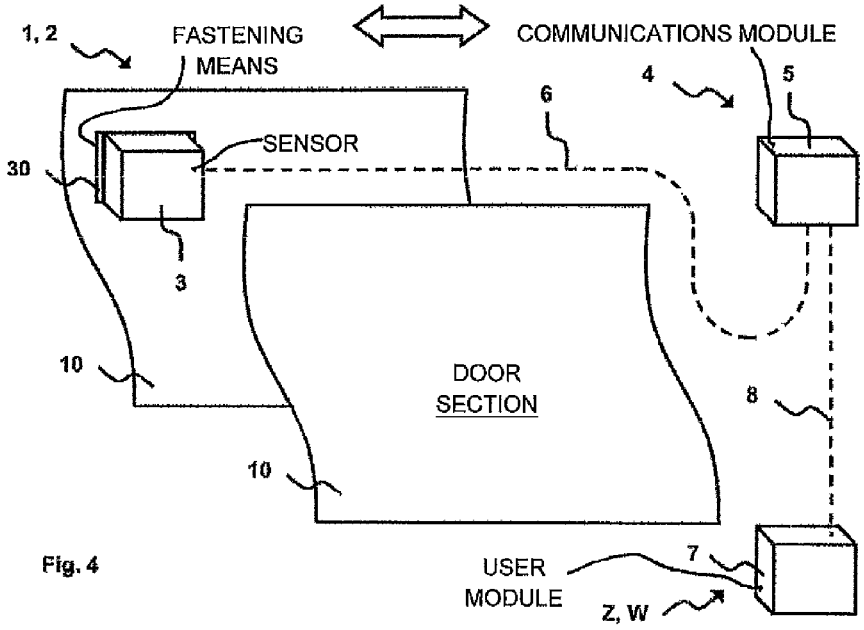
FIG. 4 shows a schematic view of a part of a fourth exemplifying embodiment of an elevator installation with an acceleration sensor at a door.

According to FIGS. 1, 3 and 4 a signal cable is realized as communications path 6 between the acceleration sensor and the communications module 5. The signal cable can be a USB cable which, apart from the communication of the acceleration signals, also provides an electrical power supply of the acceleration sensor 3. According to FIG. 4 the USB cable is realized with a length compensation between the movable door section 10 of the door 1, 2 and the stationary communications module 5 in such a manner that compensation is provided by the length compensation for the door movement during opening and/or closing of the door 1, 2.

According to FIGS. 2 and 5 a radio connection is realized as communications path 6 between the acceleration sensor 3 and the communications module 5. The radio connection can be effected in accordance with Bluetooth, ZigBee or WiFi, or it can be passive. The electrical power supply of the acceleration sensor 3 can be carried out in cable-bound manner, for example by a direct voltage 5 V or 9 V. The electrical power supply of the acceleration sensor 3 and/or of the communications module 5 can, however, also be effected by an energy store such as a battery, an accumulator, a fuel cell, etc. The energy supply is mounted at the movable door section 10, for example between two door panels 10. The energy store is, for example, designed for independence of the acceleration sensor 3 and/or of the communications module 5 in terms of energy of a year, preferably two or more years. The electrical power supply is renewed by exchange of the energy store. This exchange can be carried out by a maintenance engineer W.

The communications module 5 can bidirectionally communicate in at least one network 8 with at least one user module 7. For that purpose the computer program means of the communications module 5 establishes a communication between the communications module 5 and the central station Z and/or the maintenance engineer W and maintains this communication.

The network 8 can be realized by radio network and/or fixed network. In FIGS. 1 to 5 a radio network is illustrated by curved multiple lines and a fixed network is illustrated by a dashed line. Known radio networks are Global System for Mobile Communication (GSM), Universal Mobile Telecommunications Systems (UMTS), Bluetooth, Zigbee or WiFi.

Known fixed networks are the cable-bound Ethernet, Power Line Communication (PLC), etc. PLC allows data transmission by way of the electrical power supply of the car 4 or by way of other existing lines of the car 4. Known network protocols for communication are TCP/IP, UDP or IPX.

In alternative embodiments, the radio connection 6 uses the communications module 5 as well as the user module 7 for a sender and a receiver for bidirectional communication over the radio network 8. In case the communications module 5 is already equipped for a radio-based, bidirectional communication with the acceleration sensor 3, the present sender and/or receiver can be used.

According to FIGS. 2, 3 and 4 a fixed network is realized between the communications module 5 and the user module 7 as network 8. The communications module 5 is then, for example, a fixed network modem. According to FIGS. 1, 3 and 5 a radio network is realized between the communications module 5 and the user module 7 as network 8. The communications module 5 is then, for example, a radio network modem. According to FIG. 3 the communications module 5 is not only a fixed network modem for communication with a central station Z, but also a radio network modem for communication with a maintenance engineer W.

The acceleration signals communicated by the acceleration sensor 3 to the communications module 5 are communicated by the communications module 5 in the network 8 to at least one user module 7. The user module 7 can be located in at least one central station Z and/or with at least one maintenance engineer W. The central station Z is stationary and can be located remotely from the building G or in the building G. According to FIG. 2 the central station Z is located remotely from the building G as a remote maintenance station and according to FIG. 3 the central station Z is located in the building G as a building central station. The maintenance engineer W is mobile and can be located not only in the remote maintenance center, i.e. in a building central station, but also in accordance with FIG. 1 en route from the remote maintenance center to the building G or according to FIG. 3 in the building G.

The user module 7 has at least one corresponding communications module and can bidirectionally communicate in the network 8 with the communications module 5 of the elevator installation A. The user module 7 comprises at least one processor 7*a* and at least one computer readable data memory 7*b*, which are arranged in and/or at the housing of the user module 7 as shown in FIG. 5. The processor 7*a* and the computer readable data memory 7*b* are arranged on a circuitboard 7*c* and connected together by way of at least one signal line 7*d*. At least one computer program means is loaded from the computer readable data memory 7*b* into the processor 7*a* and executed. The computer program means establishes a communication between the user module 7 and the communications module 5 and maintains this communication.

The computer program means of the communications module 5 and/or of the user module 7 evaluates communicated acceleration signals. The evaluation of the acceleration signals supplies maintenance data such as an "acceleration of the door" and/or an "acceleration of the car". The acceleration is detected in directionally dependent manner and differentiated into maintenance data such as an "opening acceleration or closing acceleration of the door" and/or an "upward acceleration and/or downward acceleration of the car". A simple integration of the acceleration signals over time supplies maintenance data such as a "speed of the door" and/or a "speed of the car". The speed is similarly detected in directionally dependent manner and differentiated into maintenance data such as an "opening speed or closing speed of the door" and/or an "upward speed and/or downward speed of the car". A double integration of the acceleration signals over time supplies maintenance data such as a "travel path of the door" and/or a "travel path of the car". The travel path is also detected in directionally dependent manner and differentiated into maintenance data such as an "opening travel path or closing travel path of the door" and/or an "upward travel path or downward travel path of the car".

The computer program means further determines an item of maintenance information "time instant of the start of acceleration of the door" and an item of maintenance information "time instant of the end of deceleration of the door" in the evaluation. The computer program means determines therefrom at least one item of maintenance information such as a "number of door movements". The computer program means determines from the difference of the time instants as an item of maintenance information a "time duration of the door movement". In addition, the computer program means determines an item of maintenance information "time instant of the start of deceleration of the car" and an item of maintenance information "time instant of the end of acceleration of the car". The computer program means determines therefrom an item of maintenance information such as a "number of car journeys" and/or a "number of floor stops of the car". In addition, the computer program means determines from the difference of these time instants as item of maintenance information a "time duration of a car journey" and/or a "time duration of a floor stop of the car".

Items of maintenance information such as a "number of door movements" and/or a "number of car journeys" and/or a "number of floor stops of the car" and/or a "time duration of a car journey" and/or a "time duration of a floor stop of the car" can be summated in freely selectable time windows. This summation can be carried out in floor-specific manner. An item of maintenance information "time plot of the door movements" and/or "time plot of the car journeys", and/or "time plot of the floor stops of the car" is provided as result of this summation. By a time plot of a state magnitude there is understood the behavior over time of the state magnitude. The "time plot of the door movements" and/ "time plot of the car journeys" and/or the "time plot of the floors stops of the car" accordingly indicates the door movements, car journeys and/or floor stops, respectively, coded in terms of time.

Acceleration signals of a triple-axis acceleration sensor supply, as items of maintenance information and/or "horizontal vibrations of the door" and/or "vertical vibrations of the door" and/or "horizontal vibrations of the car" or vertical vibrations of the car".

An alarm report and/or a serviceability report is generated by the processor in dependence on items of maintenance information. For that purpose the computer program means compares at least one item of maintenance information with at least one reference value. The reference value is loaded by way of the signal line from the computer readable data memory into the processor. In the case of a negative comparison result at least one alarm report is generated and in the case of a positive comparison result at least one serviceability report is generated.

The computer program means determines a degree of correspondence of the item of maintenance information "acceleration of the door" with a reference value in the form of a reference acceleration of the door. A normal door acceleration is present when the "acceleration of the door"

is less than 0.3 m/sec$^2$. The computer program means determines a degree of correspondence of the item of maintenance information "acceleration of the car" with a reference value in the form of a reference acceleration of the car. A normal car acceleration is present when the "acceleration of the car" is less than 2.0 m/sec$^2$.

The computer program means determines a degree of correspondence of the item of maintenance information "speed of the door" with a reference value in the form of a reference speed of the door. A normal door speed is present when the "speed of the door" is less than 1.0 m/sec. The computer program means determines a degree of correspondence of the item of maintenance information "speed of the car" with a reference value in the form of a reference speed of the car. A normal car speed is present when the "speed of the car" is less than 10 m/sec, preferably less than 17 m/sec.

The computer program means determines a degree of correspondence of the item of maintenance information "travel path of the door" with a reference value in the form of a reference travel path of the door. A normal door movement is present, i.e. the door is completely opened and/or closed, when the "travel path of the door" is at least 99% of the reference travel path of the door. The computer program means determines a degree of correspondence of the item of maintenance information "travel path of the car" with a reference value in the form of a reference travel path of the car. A normal car travel is present, i.e. the car is located completely at the floor stop so that the thresholds of car door and floor door are substantially flush, when the "travel path of the car" is at least 99% of the reference travel path of the car. The thresholds of car door and floor door are typically flush when the height difference between the car floor and the floor level is less than 15 mm, preferably less than 10 mm, so that a passenger does not trip when entering and/or leaving the car.

The computer program means determines a degree of correspondence of the item of maintenance information "time duration of the door movement" with a reference value in the form of a reference time duration of the door movement. A normal door movement is present when the "time duration of the door movement" is between 3.5 and 3.0 sec. A slow door movement is present when the "time duration of the door movement" is more than 3.5 sec. The computer program means determines a degree of correspondence of the item of maintenance information "time duration of the car travel" with a reference value in the form of a reference time duration of the car travel. A normal car travel is present when the "time duration of the car travel" is less than 2 min. The computer program means determines a degree of correspondence of the item of maintenance information "time duration of a floor stop of the car" with a reference value in the form of a reference time duration of a floor stop of the car. A normal floor stop is present when the "time duration of a floor stop of the car" is less than 60 sec.

The computer program means determines a degree of correspondence of the item of maintenance information "number of door movements" with a reference value in the form of a reference number of door movements. A preventative maintenance of the door is recommended whenever the "number of door movements" attains a resettable value of 20,000. The computer program means determines a degree of correspondence of the item of maintenance information "number of car journeys" with a reference value in the form of a reference number of the car journeys. A preventative maintenance of the door is recommended every time the "number of car journeys" attains a resettable value of 10,000. The computer program means determines a degree of correspondence of the item of maintenance information "number of floor stops" with a reference value in the form of a reference number of floor stops. A preventative maintenance of the door is recommended every time the "number of floor stops" attains a resettable value of 10,000.

The computer program means determines the degree of correspondence of the detected vibrations with reference values in the form of reference vibrations. The degree of correspondence can be measured in mg and quantified. For example, horizontal vibrations are still acceptable if they lie in the region of greater than or equal to 13 to 16 mg; horizontal vibrations are low when they lie in the range of greater than or equal to 10 to 13 mg and horizontal vibrations are very small when they lie below 10 mg. Correspondingly, vertical vibrations are still acceptable when they lie in the region of greater than or equal to 15 to 18 mg; vertical vibrations are low when they lie in the region of greater than or equal to 10 to 15 mg and vertical vibrations are very small when they lie below 10 mg.

The computer program means determines a degree of correspondence of the item of maintenance information "time plot of the door movements" with a reference value in the form a reference time plot of the door movements. A preventative maintenance of the door is recommended as soon as the "time plot of door movements" deviates from the reference time plot of the door movements. The computer program means determines a degree of correspondence of the item of maintenance information "time plot of the car journeys" with a reference value in the form of a reference time plot of the car journeys. A preventative maintenance of the door is recommended as soon as the "time plot of the car journeys" deviates from the reference time plot of the car journeys. The computer program means determines a degree of correspondence of the item of maintenance information "time plot of the floor stops of the car" with a reference value in the form of a reference time plot of the floor stops of the car. A preventative maintenance of the door is recommended as soon as the "time plot of the floor stops of the car" deviates from the reference time plot of the floor stops of the car.

An alarm report is generated if an "acceleration of the door" and/or an "acceleration of the car" and/or a "speed of the door" and/or a "speed of the car" and/or a "travel path of the door" and/or a "travel path of the car" and/or a "time duration of the door movement" and/or a "time duration of the car journey" and/or a "time duration of a floor stop of the car" and/or a "number of door movements" and/or a "number of car journeys" and/or a "number of floor stops of the car" and/or "horizontal vibrations of the door" and/or "vertical vibrations of the door" and/or "horizontal vibrations of the car" and/or "vertical vibrations of the car" exceeds a reference value.

An alarm report is generated if a "time plot of the door movement" and/or a "time plot of the car journeys" and/or a "time plot of the floor stops of the car" deviates from a reference value.

A serviceability report is generated if an "acceleration of the door" and/or an "acceleration of the car" and/or a "speed of the door" and/or a "speed of the car" and/or a "travel path of the door" and/or a "travel path of the car" and/or a "time duration of the door movement" and/or a "time duration of the car journey" and/or a "time duration of a floor stop of the car" and/or a "number door movements" and/or a "number of car journeys" and/or a "number of floor stops of the car" and/or "horizontal vibrations of the door" and/or "vertical vibrations of the door" and/or "horizontal vibrations of the car" and/or "vertical vibrations of the car" falls below a reference value.

The communications module 5 communicates an alarm report to the user module 7 of the central station Z and/or to the user module 7 of the maintenance engineer W. The communications module 5 communicates the alarm report together with detected acceleration signals and/or with at least one item of maintenance information. The central station Z investigates the detected acceleration signals and/or item of maintenance information, communicated with the alarm report and if a disturbance of the elevator installation A, which is linked with the alarm report, cannot be eliminated in another mode and manner summons at least one maintenance engineer W who undertakes appropriate maintenance of the elevator installation A in the building G.

The maintenance engineer W can investigate the item of maintenance information "time plot of the door movement", which was transmitted by the communications module 5, either in the central station Z or also on the way to the elevator installation A and thus determine the quality of the door movement specifically to floor without, as previously usual, he or she having to go on site to each floor S1-S3 to check the correct opening and closing of the doors 1, 2. This saves time and cost.

The central station Z and/or the maintenance engineer W can derive from the item of maintenance information "time plot of the car journeys" a favorable point in time for a maintenance visit where, in particular, little traffic is anticipated and a possible switching-off of a car 4 of the elevator installation A causes little disturbance.

An existing elevator installation of at least one door 1, 2 and at least one car 4 can be modernized in simple manner in that at least one acceleration sensor 3 is mounted on the door 1, 2; at least one communications module 5 is mounted in stationary position at the elevator installation A or at the car 4 to be mobile; and the acceleration sensor 3 is connected with the communications module 5 by way of at least one communications path 6.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

What is claimed is:

1. A method, comprising:

generating accelerometer measurements using an accelerometer positioned on an elevator door;

wirelessly transmitting the generated accelerometer measurements from the accelerometer to a receiver; and generating maintenance data using the transmitted accelerometer measurements.

2. The method of claim 1, the elevator door comprising an elevator car door.

3. The method of claim 2, the generated accelerometer measurements indicating accelerations of an elevator car.

4. The method of claim 2, the generated accelerometer measurements indicating accelerations of the elevator car door.

5. The method of claim 1, the receiver being mounted in an elevator shaft.

6. An elevator installation, comprising:

an elevator car disposed in a shaft, the elevator car comprising a car door;

a floor door positioned at a floor served by the elevator car;

an acceleration sensor attached to the car door or to the floor door;

a receiver that wirelessly receives accelerometer measurements transmitted from the acceleration sensor; and a processor that generates maintenance data using the transmitted accelerometer measurements.

7. The elevator installation of claim 6, the acceleration sensor being attached to the car door and the receiver being attached to the elevator car.

8. The elevator installation of claim 6, the receiver being attached to a wall of the shaft.

9. The elevator installation of claim 6, the receiver being located outside of the shaft.

10. One or more computer-readable storage media having encoded thereon instructions that, when executed by a processor, cause the processor to perform a method, the method comprising:

generating accelerometer measurements using an accelerometer positioned on an elevator door;

wirelessly transmitting the generated accelerometer measurements from the accelerometer to a receiver; and generating maintenance data using the transmitted accelerometer measurements.

* * * * *